United States Patent [19]

Carville et al.

[11] 4,188,559

[45] Feb. 12, 1980

[54] ROTARY ANODE X-RAY TUBE

[75] Inventors: Charles Carville; André Laffitte, both of Paris, France

[73] Assignee: Compagnie Generale de Radiologie, Paris, France

[21] Appl. No.: 928,216

[22] Filed: Jul. 28, 1978

[30] Foreign Application Priority Data

Jul. 29, 1977 [FR] France ..... 77 23444

[51] Int. Cl.[2] ..... H01J 35/10; H01J 35/16

[52] U.S. Cl. ..... 313/60; 313/149; 313/312

[58] Field of Search ..... 313/60, 149, 312

[56] References Cited

U.S. PATENT DOCUMENTS

| | | | |
|---|---|---|---|
| 2,071,696 | 2/1937 | Jonas | 313/60 X |
| 2,496,112 | 1/1950 | Van Der Tuuk et al. | 313/60 X |
| 2,890,358 | 6/1959 | Cummings | 313/60 X |
| 2,939,015 | 5/1960 | Reiniger | 313/60 X |
| 3,500,097 | 3/1970 | Perry et al. | 313/60 X |
| 3,753,021 | 8/1973 | Braun | 313/60 |

FOREIGN PATENT DOCUMENTS

| | | | |
|---|---|---|---|
| 646274 | 11/1950 | United Kingdom | 313/60 |

*Primary Examiner*—Palmer C. Demeo
*Attorney, Agent, or Firm*—Edwin E. Greigg

[57] ABSTRACT

A rotary anode X-ray tube capable of operating at very high voltages of several hundred thousand volts.

The rotor and the stator of the motor for the rotary anode are electrically connected to the anode which is itself raised to a positive DC potential, while the cathode is raised at a symmetrical negative potential. The rotor and the stator are separated by a thin non-magnetic wall which makes part of the vacuum enclosure, said wall being connected to the remainder of the enclosure by means of a fold of glass.

1 Claim, 1 Drawing Figure

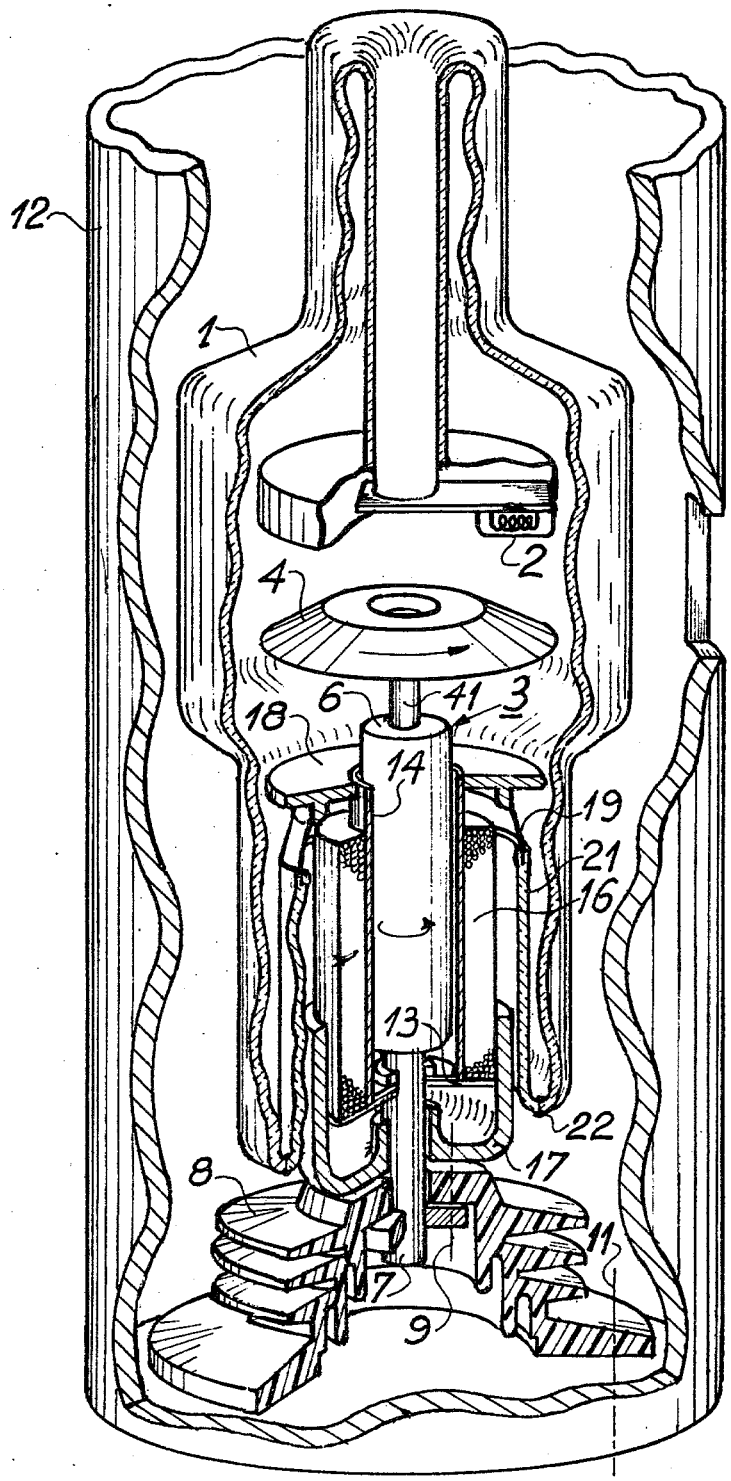
12
1
2
4
6
41
3
18
14
19
21
16
13
22
17
8
11
7
9

ROTARY ANODE X-RAY TUBE

The present invention relates to an X-ray tube with a rotary anode, wherein the stator is at the same potential as the anode that it drives in rotation and wherein said stator is situated within the sealed enclosure of the tube which contains the cathode and the rotary anode; the stator of the motor is situated outside this enclosure.

In certain prior art tubes, the high voltage is applied between the cathode and anode symmetrically with respect to earth (or ground). The rotor, which is raised to a high positive potential, needs to be suitably insulated from the stator, whose carcase is connected to ground potential. This insulation is generally provided partly by the glass wall of the enclosure, which separates the rotor and stator, and partly by using an air gap of large dimensions. However, this solution results in a high reluctance in the air gap and thus makes it necessary for the motor to be of large size and high electrical power to achieve the requisite torque.

This drawback becomes prohibitive when the high voltage used exceeds 100 kilovolts and becomes as much as 300 or 400 kilovolts. With such voltages the air gap would in fact need to be as large as several centimeters.

Another kind of tube has already been proposed in which an attempt is made to reduce some of these drawbacks. In this tube, the rotor, which is electrically connected to the anode, is at the same DC potential as the stator, all of them being connected to earth. With this solution, there are no longer any problems of electrical insulation between the stator and rotor and the air gap may be considerably reduced. It has also been proposed with this solution to position the stator and rotor very close to one another and to separate them only by the wall of the sealed enclosure, which wall is made in this region of the enclosure, from a metal which is a poor conductor of electricity.

It is clear that in a tube of this kind where the air gap is considerably reduced the efficiency of the motor is increased.

There is however still a limitation on the high voltage between the anode and the cathode and this restricts the use of tubes of this kind towards the upper end of the range. This restriction is due to the fact that the whole of the high voltage is applied between the cathode and earth, which is the basis on which tubes of this kind were designed, and the tubes cannot operate at high voltages of more than 100 kV without insurmountable insulation problems arising. It should also be noted that in the present state of the art there are in existence no supply cables which are flexible, as is necessary in radiology, and capable of carrying voltages higher than 150 kV.

The object of the present invention is a tube capable of operating at very high voltages which may be as much as several hundred kilovolts.

An X-ray tube according to the invention comprises in a sealed enclosure partly made of glass: a cathode and a rotary anode secured to the rotor of a motor whose stator is situated outside said enclosure, said rotor and stator, which are both at the same DC potential as said anode, being separated by a wall of non-magnetic metal which forms part of said sealed enclosure, said wall which separates the rotor and the stator being fixed to the remainder of said sealed enclosure in an arrangement which on the one hand lengthens the path of the leakage lines between the cathode and anode in such a way as to provide electrical insulation which is suitable even for very high operating voltages, annd which on the other hand produces an electrical screen between said stator and earth, the high voltage necessary for operating said tube being applied between said anode and said cathode symmetrically with respect to earth.

An embodiment of X-ray tube according to the invention is described below and illustrated schematically in the single accompanying FIGURE, by way of example.

The tube essentially comprises an enclosure 1, generally of glass, at the ends of which are attached a cathode 2, and an anode assembly 3. This assembly is in turn made up of an anode plate 4 which is secured at 41 to a rotor formed by a hollow cylinder 6. By means of a rolling element bearing, this rotor 6 turns on a fixed shaft 7 which is mounted in an insulating block 8 by means of screws which are indicated diagrammatically by broken lines 9. The block 8 is in turn attached by screws 11 to the inside of a metal casing 12 connected to earth.

To the fixed shaft 7 is attached, in a vacuum-tight fashion, a support plate 13 to which is joined a cylinder 14 of non-magnetic material which will form part of the wall of the sealed enclosure 1. The clearance between the rotor 6 and the cylinder 14 forms the air gap of the motor (at the vacuum of the sealed enclosure). It is as small as assembly requirements permit it to be and is of the order of a few tenths of a millimeter.

The inductor 16 of the anode motor is set up in a push fit way on the cylinder 14 and is carried by a support 17 which is also attached to the insulator 8 by the screws 9. The other end of the cylinder 14 is welded in a sealed fashion to a metal plate 18 which acts as a protective screen between the anode, which is a major source of heat, and the stator 16 of the motor. A skirt 19 is soldered to the screen 18 and sealed to a glass sleeve 21. The sleeve 21 is connected to the rest of the enclosure 1 by welds 22.

The high voltage for the tube is applied between the positive anode and the negative cathode, symmetrically with respect to earth. The casing 12 is itself raised to earth potential.

In this way the anode, the rotor and the stator are at the same positive DC potential, which enables the air gap to be considerably reduced. Furthermore, the wall 14 of non-magnetic metal which separates the rotor and stator produces an air gap of low reluctance, which enables the motor to be of acceptable size and power even when the high voltages are very high.

As to the symmetrical application of the high voltage between the cathode and anode, this enables the tube to be operated at very high voltages, of the order of several hundred kilovolts, this being made possible in particular by the presence of the fold of glass 21, 22 which connects the skirt 19 to the upper part of the enclosure 1, and the presence of the metal plate 18. The fold of glass on the one hand acts as a high-voltage screen between the stator/rotor combination, which is raised to the positive DC potential of the anode, and the grounded casing, and on the other hand lengthens the leakage lines between the same combination and the cathode. As to the plate 18, this acts as a thermal screen between the anode, which heats up to a greater extent the higher the power involved, and the motor, which is thus protected.

To assemble the tube, operations begin with the making of a glass to metal seal between the sleeve 21 and the skirt 19. The sealed welds between the cylinder 14 and the plate 18, and the skirt 19 and the same plate 18, are then easily made. The presence of the screen plate 18 thus makes assembly easier.

The welding of the sleeve 21 to the enclosure 1 at point 22 gives the enclosure a folded configuration and this, as already mentioned, increases the length of the leakage lines between the anode and the cathode.

Tubes of this kind are especially suited to operate at high powers and at very high voltages of as much as several hundred thousand volts.

What is claimed is:

1. In an X-ray tube disposed within a grounded metal casing including a sealed enclosure having a glass portion in which are positioned a fixed cathode, a motor having a rotor and a stator disposed outside of the enclosure and a rotary anode secured to the rotor, a fixed shaft extending outside of and tightly connected to the enclosure with the rotor rotatably mounted on the fixed shaft, the rotor and stator being at the same DC potential as the anode and separated by a separating wall of non-magnetic metal forming part of the sealed enclosure, the improvement which comprises, a U-shaped glass fold having two branches in said sealed enclosure glass portion, said U-shaped fold arranged to extend around the assembly comprising said rotor, said stator and said separating wall whereby said two branches are interposed between said assembly and said metal casing, a metal plate for tightly connecting the free end of said U-shaped glass fold to the extremity of said separating wall closest to said anode so as to provide a thermal screen between said anode and said motor, said U-shaped glass fold interposed between said motor and said metal casing permitting the application of a high DC voltage, necessary for operating the tube, between said anode and said cathode symmetrically with respect to ground whereby said tube can be operated at very high voltages.

* * * * *